US011953275B1

(12) United States Patent
Johnson et al.

(10) Patent No.: US 11,953,275 B1
(45) Date of Patent: Apr. 9, 2024

(54) FIXED POSITION FIREARM EJECTOR

(71) Applicants: Sean Vern Johnson, Kent, WA (US); Kenneth Frankel, Issaquah, WA (US)

(72) Inventors: Sean Vern Johnson, Kent, WA (US); Kenneth Frankel, Issaquah, WA (US)

( * ) Notice: Subject to any disclaimer, the term of this patent is extended or adjusted under 35 U.S.C. 154(b) by 0 days.

(21) Appl. No.: 18/097,000

(22) Filed: Jan. 13, 2023

(51) Int. Cl.
*F41A 15/16* (2006.01)

(52) U.S. Cl.
CPC ..... *F41A 15/16* (2013.01)

(58) Field of Classification Search
CPC ..... F41A 15/00; F41A 15/04; F41A 15/06; F41A 15/08; F41A 15/10; F41A 15/12; F41A 15/14; F41A 15/16; F41A 15/18; F41A 15/20; F41A 15/22
USPC ..... 42/25
See application file for complete search history.

(56) References Cited

U.S. PATENT DOCUMENTS 3,090,148 A * 5/1963 Smith ..... F41A 9/55 42/16
3,500,718 A * 3/1970 Stoner ..... F41A 7/08 89/43.01
6,289,619 B1 * 9/2001 Fuchs ..... F41A 19/48 42/70.08
2011/0072704 A1 * 3/2011 Teach, Jr. ..... F41A 19/183 42/8
2017/0198999 A1 7/2017 Goddard et al.
2017/0299303 A1 * 10/2017 Phipps ..... F41A 17/36
2017/0356709 A1 * 12/2017 Mock ..... F41A 3/66
2018/0313622 A1 11/2018 Dionne
2018/0347925 A1 * 12/2018 Gibbens ..... F41A 15/16
2022/0057156 A1 2/2022 Gangl
2023/0272989 A1 * 8/2023 McMinn ..... F41A 3/94 89/191.01

* cited by examiner

*Primary Examiner* — Bret Hayes
(74) *Attorney, Agent, or Firm* — Thomas E Loop

(57) ABSTRACT

A fixed position ejector detachably connectable to a firearm is disclosed. The ejector comprises a base having an elevated forwardly extending finger, wherein the finger has an outer finger face configured for contacting a cartridge or case during the ejection phase of the firing cycle of the firearm. The base has forward and rear downwardly extending posts that are configured to engage into respective forward and rear retaining post holes positioned on the upper frame surface. At least one of the forward and rear posts includes a downwardly slanted notch. A retaining screw is provided to adjustably engage into both (i) a through-hole positioned adjacent and perpendicular to the upper frame surface of the firearm, and (ii) the slanted notch of one of the forward and rear posts such that the retaining screw urges the bottom base surface of the base against the upper frame surface of the firearm.

5 Claims, 5 Drawing Sheets

FIXED POSITION FIREARM EJECTOR

TECHNICAL FIELD

The present invention relates generally to ejectors for ejecting spent bullet casings from a chamber of a firearm, and more particularly, to fixed position firearm ejectors.

BACKGROUND OF THE INVENTION

All firearms are guns; these terms are synonymous. A handgun is a gun that fits in your hand and includes both pistols and revolvers. A pistol has a stationary chamber, whereas a revolver has a chamber (cylinder) that spins. In general terms, a firearm is a portable barreled weapon that uses explosive powder (gun powder) to propel a metal projectile (a bullet) towards a target.

An ejector refers to the part of a gun that causes the shell (also referred to as the cartridge or casing)—fired or unfired—to exit the gun. On a pistol, the ejector is generally fitted to the frame slide, whereas on a revolver, it is generally in the form of a spring-tensioned rod positioned in the middle of the cylinder. Generally speaking, and at the end of a semi-automatic pistol's firing cycle when the slide moves backward, the forward face of the ejector, in turn, comes into contact with the spent shell and causes it to fly out of the gun at the ejection port. The slide then moves forward and picks up a new shell from the spring-loaded magazine. Stated somewhat differently, the slide chambers ammunition into the barrel and extracts the spent casing after the round is fired by sliding backwards along its tracks during the recoil process thereby causing the moving casing to contact and interact with the stationary ejector. The pistol's firing cycle may then be repeated.

Although ejector technology has advanced over the years, there is still a need in the art for new and improved ejectors—especially fixed position ejectors that are easily and readily detachable to a gun by its user (and not a gunsmith) while also being highly resistant to displacement due to heavy use of the gun over extended periods of time. The present invention fulfills these needs and provides for further related advantages.

SUMMARY OF THE INVENTION

In brief, the present invention in an embodiment is directed to, in combination, a firearm and an ejector that is detachably connectable to the firearm by means of a single transverse retaining screw that spans across the width of the frame mount section of the firearm. The ejector component (of the combination) comprises a base section having an elevated forwardly protruding finger (positioned parallel to the slide's tracks), wherein the finger has an outer finger face configured for contacting a shell (cartridge or case) during the ejection phase of the firing cycle of the firearm. In addition, the base section also has downward protruding forward and rear retaining posts configured to engage into respective forward and rear post receiving holes (positioned on an upper surface of the frame mount section of the firearm adjacent to one of the frame's tracks). At least one of the forward and rear posts includes a slanted notch configured to receive a retaining screw. In this configuration, the perpendicular retaining screw is able to adjustably engage into both (i) a transverse horizontal through-hole positioned adjacent and parallel to the upper firearm surface of the firearm, and (ii) the slanted notch of one of the forward and rear posts, such that the retaining screw urges the bottom base surface of the base section of the ejector firmly against the upper firearm surface of the frame component of the firearm.

Put differently, the retaining screw, when engaged, maintains contact with and applies a steady downward force (tension) to and along the notched post thereby urging (pushing) the flat bottom base surface of the ejector against the flat upper surface of the firearm frame such that the ejector is highly resistant to displacement (dislodgement) due to the firearm's use over extended periods of time.

These and other aspects of the present invention will become more evident upon reference to the following detailed description and accompanying drawings. It is to be understood, however, that various changes, alterations, and substitutions may be made to the specific embodiments disclosed herein. The described and illustrated embodiments are to be considered as illustrative and not restrictive.

BRIEF DESCRIPTION OF THE DRAWINGS

The drawings are intended to be illustrative of certain preferred embodiments of the present invention and as such they may not necessarily be drawn to scale. In addition, like reference numerals have been used to designate like parts and features throughout the several views of the drawings.

DETAILED DESCRIPTION OF THE INVENTION

Figure 1:
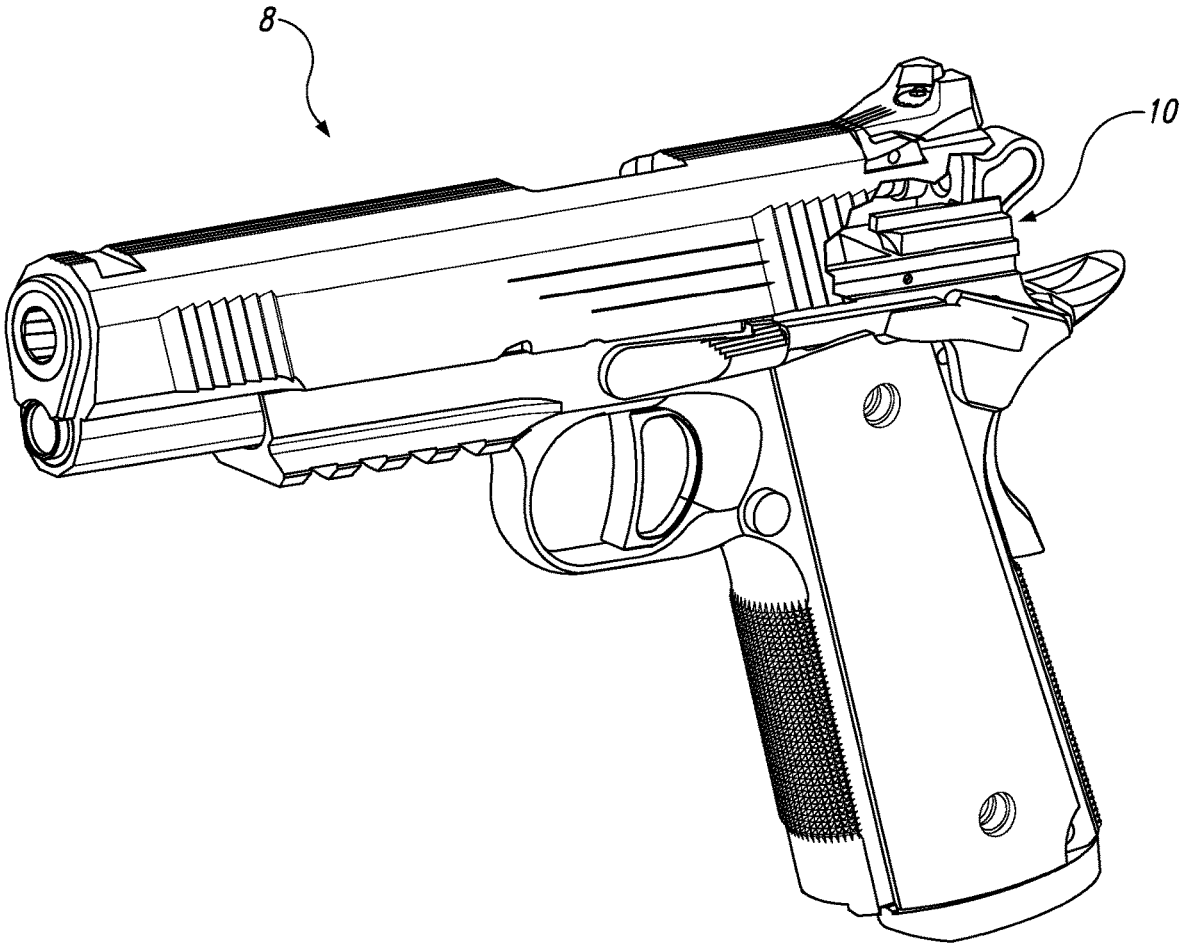
FIG. 1 is a perspective view (with a rear cut-away section) of a handgun in combination with an ejector in accordance with an embodiment of the present invention.

The present invention may be understood more readily by reference to the following detailed description of certain preferred embodiments of the invention in view of the accompanying drawings. It is to be understood that the terminology used herein is for the purpose of describing specific embodiments only and is not intended to be limiting. It is to be further understood that unless specifically defined herein, the terminology used herein is to be given its conventional meaning as understood in the relevant art. Any headings used within this document are only being utilized to expedite its review by the reader, and should not be construed as limiting the claimed invention in any manner. In addition, the relative terms forward and front, rearward and back, upward and upper, and downward and lower, as used within this document, signify the relative positions of a handgun when held by a shooter in a typical horizontal firing position with (i) forward and front meaning the end or direction of the handgun that has the muzzle, (ii) rearward and rear meaning the end or direction opposite of forward, (iii) upward and upper meaning the top or barreled side of the handgun, and (iv) downward and lower meaning the bottom side or direction opposite of upward.

Referring now to FIGS. 1-6, the present invention in an embodiment is directed to, in combination, a firearm 8 and a fixed position ejector 10 that is detachably connectable to the firearm 8 by means of a single transverse retaining screw 22 that spans across the width of the slide mount section of the frame of the firearm 8. The retaining screw 22 is preferably threaded and includes a screw head having a hex recess for engagement with a hex wrench (not shown). The ejector 10 component (of the combination), as shown, comprises a base section 12 having a flat bottom base surface 12*b* and an elevated forwardly protruding finger 14. The ejector 10 component is preferably metallic and made from a high-quality steel alloy blank by machining.

Figure 4:
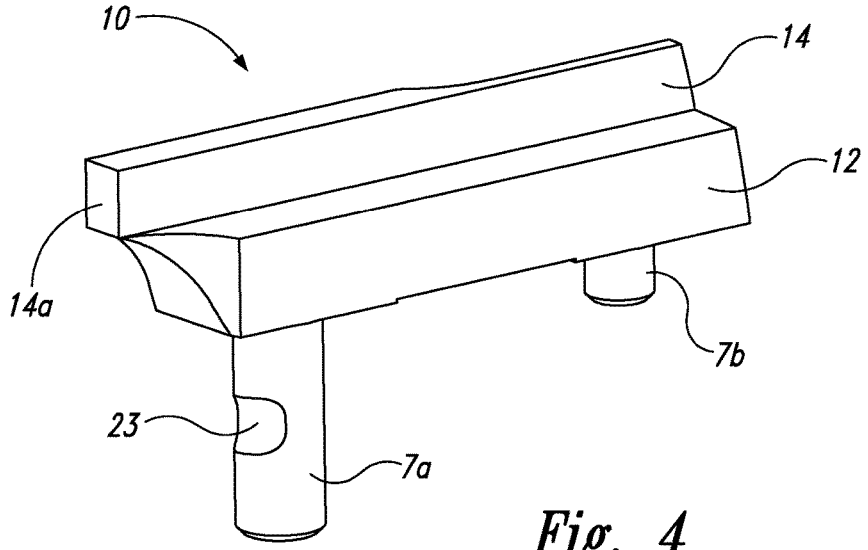
FIG. 4 is an enlarged perspective view of the ejector shown in FIGS. 1-3, but where the ejector is shown in isolation (i.e., not mounted to the slide mount of the frame).
Figure 5:
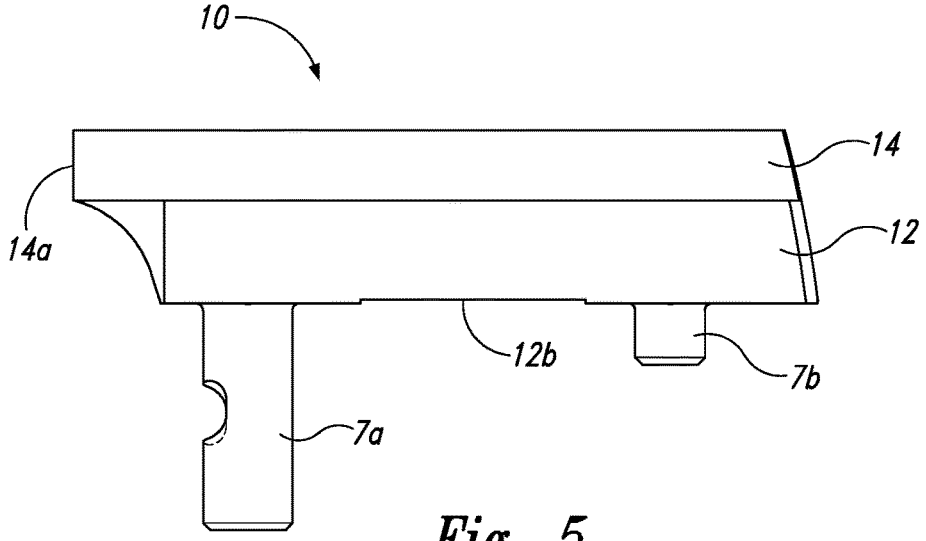
FIG. 5 is an enlarged side view of the ejector shown in FIG. 4.

As best shown in FIGS. 4 and 5, the forward protruding finger 14 has an outer finger face 14*a* configured for contacting a shell (not shown) during the ejection phase of the firing cycle of the firearm 8. The forward protruding finger 14, when the ejector 10 is fixedly engaged/mounted to an upper surface 8*a* of the frame of the firearm 8, is preferably parallel to the tracks of the slide mount (as best shown in FIG. 2A).

Figure 6:
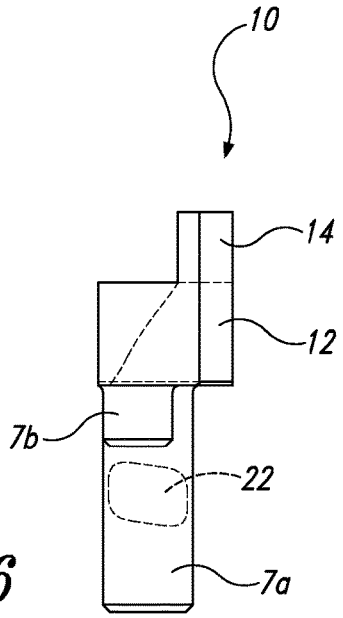
FIG. 6 is an enlarged front view of the ejector shown in FIGS. 4 and 5.

In addition, and as best shown in FIGS. 4-6, the base section 12 also includes downward protruding forward and rear retaining cylindrical posts 7*a*, 7*b* configured to engage into respective forward and rear cylindrical post holes 9*a*, 9*b* (shown best in FIG. 2B) positioned on the upper surface 8*a* of the frame of the firearm 8*b* (adjacent to one of the tacks of the slide mount). As shown, the forward post 7*a* includes a front facing downwardly slanted opening or notch 23 configured to receive the retaining screw 22.

Figure 2A:
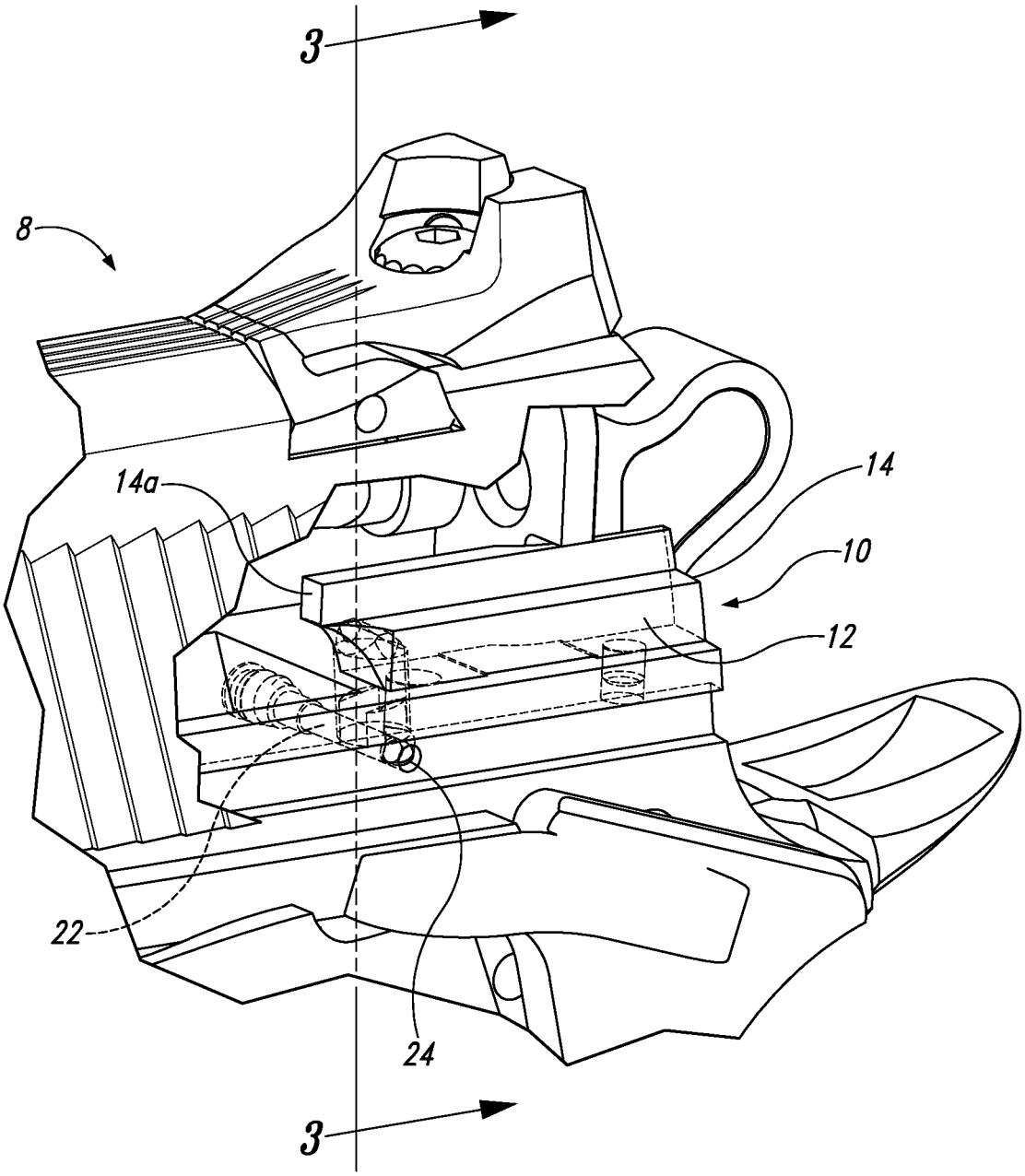
FIG. 2A is an enlarged transparent (see-through) view of the rear cut-away section of FIG. 1 and shows an enlarged view of the ejector positioned/mounted on an upper surface on the slide mount of the frame (component of the handgun) wherein the ejector is forcibly being retained in place by means of forward and rear retaining posts (engaged into respective forward and rear post holes) and a transverse retaining screw that perpendicularly spans across the width of the slide mount section and engages (and urgingly contacts) a slanted notch formed across the front face of the forward post.
Figure 2B:
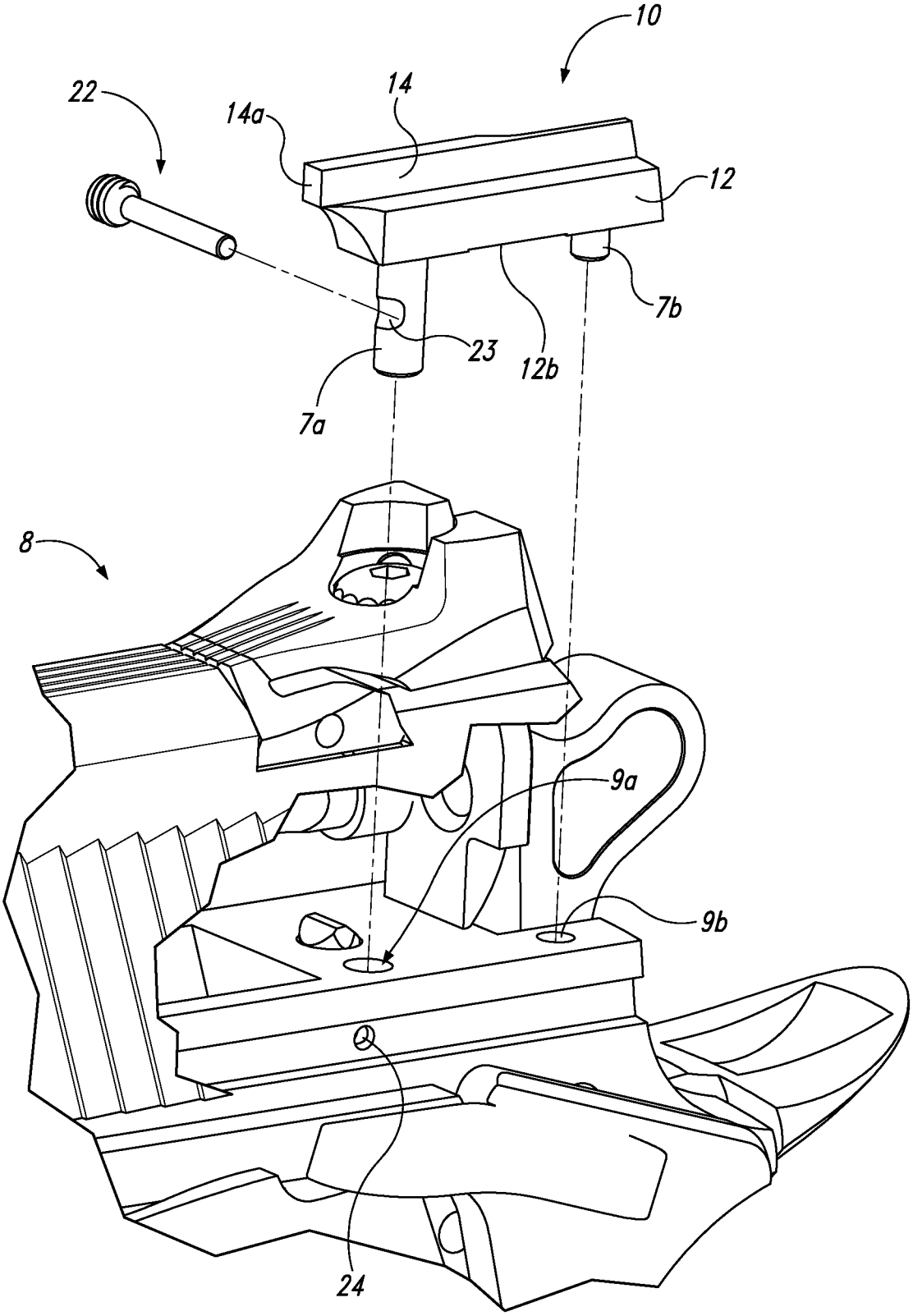
FIG. 2B is an exploded view of the enlarged view of the ejector and upper section of the slide mount of the frame shown in FIG. 2A, but where the ejector is shown positioned above and disengaged from the slide mount of the frame.
Figure 3:
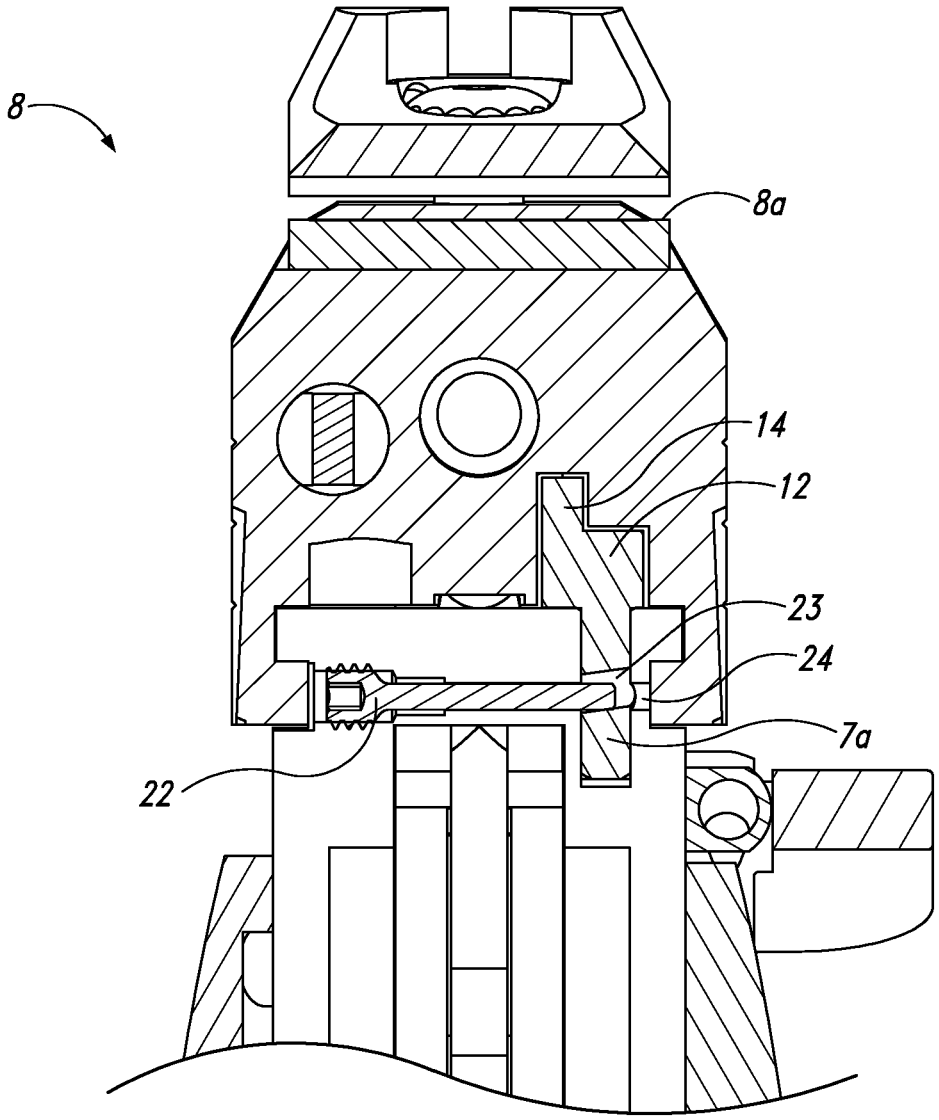
FIG. 3 is a front cross-sectional view taken along line 3-3 of FIG. 2A.

In the assembled configuration, and as best shown in FIGS. 2A and 3, the threaded transverse retaining screw 22 is adjustably engaged into both (i) a through-hole 24 positioned adjacent and parallel to the upper surface 8*a* of the firearm 8, and (ii) the slanted notch 23 of the forward post 7*a*, such that the retaining screw 22 urges the flat bottom base surface 12*b* of the base 12 section of the ejector 10 firmly against the flat upper surface 8*a* of the firearm 8. In other words, and in this configuration, the perpendicularly engaged retaining screw 22 maintains contact with and applies a constant downward force (tension) to and along the length of the forward post 7*a* thereby urging (pushing) the flat bottom base surface 12*b* of the base 12 against the flat upper surface 8*a* of the frame of the firearm 8 (such that the ejector 10 is highly resistant to displacement (dislodgement) due to the firearm's use over extended periods of time). In addition, the hex-headed retaining screw 22 can be easily removed (by means of a hex wrench) by a user such that the ejector 10 may be readily replaced with a different or new ejector.

While the present invention has been described in the context of the embodiments illustrated and described herein, the invention may be embodied in other specific ways or in other specific forms without departing from its spirit or essential characteristics. Therefore, the described embodiments are to be considered in all respects as illustrative and not restrictive. The scope of the invention is, therefore, indicated by the appended claims rather than by the foregoing description, and all changes that come within the meaning and range of equivalency of the claims are to be embraced within their scope.

What is claimed is:

1. In combination with a frame of a firearm, an ejector that is detachably connectable to an upper surface of the frame, the ejector comprising:

a base having a bottom base surface, wherein the bottom base surface matches and contacts the upper surface when the ejector is connected to, and operatively engaged with, the frame;

a finger extending forwardly away from the base, wherein the finger comprises an outer fingertip face configured for contacting a cartridge or case during the ejection phase of the firing cycle of the firearm; and forward and rear posts extending downwardly away from the bottom base surface of the base, wherein the forward and rear posts are configured to engage into respective forward and rear post holes positioned on the upper surface of the frame, and wherein one of the forward and rear posts includes a downwardly slanted opening;

a retaining screw for retaining the bottom base surface against the upper surface when the ejector is connected to the frame, wherein the retaining screw is configured to adjustably engage both into (i) a retaining screw through-hole positioned adjacent and parallel to the upper surface of the frame, and (ii) the slanted opening of one of the forward and rear posts such that the retaining screw urges the bottom base surface of the base against the upper surface of the frame.

2. The firearm and ejector combination of claim 1 wherein the downwardly slanted opening is a downwardly slanted notch.

3. The firearm and ejector combination of claim 2 wherein the ejector is metallic.

4. The firearm and ejector combination of claim 3 wherein from the bottom base surface of the base and the upper firearm surface of the firearm are both substantially flat.

5. The firearm and ejector combination of claim 4 wherein the outer fingertip face is substantially flat and perpendicular to both the bottom base surface of the base and the upper firearm surface of the firearm.

* * * * *